US010584553B2

(12) United States Patent
Levie et al.

(10) Patent No.: US 10,584,553 B2
(45) Date of Patent: Mar. 10, 2020

(54) INTEGRALLY-BONDED SWELL PACKER

(71) Applicant: INNOVEX DOWNHOLE SOLUTIONS, INC., The Woodlands, TX (US)

(72) Inventors: David E. Y. Levie, Kastanienbaum (CH); Richard Ronald Baynham, Marina di Ravenna (IT)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 244 days.

(21) Appl. No.: 15/498,729

(22) Filed: Apr. 27, 2017

(65) Prior Publication Data

US 2017/0314360 A1 Nov. 2, 2017

Related U.S. Application Data

(60) Provisional application No. 62/328,839, filed on Apr. 28, 2016, provisional application No. 62/347,904, filed on Jun. 9, 2016.

(51) Int. Cl.

| | |
|---|---|
| ***E21B 33/12*** | (2006.01) |
| ***E21B 33/127*** | (2006.01) |
| ***E21B 17/10*** | (2006.01) |

(52) U.S. Cl.

CPC ..... *E21B 33/1208* (2013.01); *E21B 17/105* (2013.01); *E21B 33/1277* (2013.01)

(58) Field of Classification Search

CPC ..... E21B 33/1208; E21B 33/1277; E21B 33/127; E21B 33/1216; E21B 33/12; E21B 33/10; E21B 17/105; E21B 17/10; E21B 17/1078; E21B 17/00

See application file for complete search history.

(56) References Cited

U.S. PATENT DOCUMENTS

| | | | | |
|---|---|---|---|---|
| 2,827,965 A | | 3/1958 | Mounce | |
| 3,243,695 A | * | 3/1966 | Roark | E21B 47/026 324/323 |
| 3,837,947 A | * | 9/1974 | Malone | E21B 33/1277 156/69 |
| 4,146,060 A | | 3/1979 | Garrett | |
| 4,291,767 A | * | 9/1981 | Hall, Jr. | E21B 33/14 166/243 |

(Continued)

FOREIGN PATENT DOCUMENTS

| | | |
|---|---|---|
| EP | 0701041 A2 | 3/1996 |
| EP | 2423430 A1 | 2/2012 |

(Continued)

OTHER PUBLICATIONS

Extended European Search Report dated Sep. 28, 2017, European Application No. 17168606.6, filed Apr. 28, 2017, pp. 1-9.

(Continued)

*Primary Examiner* — George S Gray

(74) *Attorney, Agent, or Firm* — MH2 Technology Law Group LLP

(57) ABSTRACT

A downhole tool includes a sleeve configured to be disposed around a tubular. An expandable sealing member is coupled to and positioned at least partially around the sleeve. An end ring is coupled to and positioned at least partially around the sleeve and axially-adjacent to the expandable sealing member.

24 Claims, 9 Drawing Sheets

(56) References Cited

U.S. PATENT DOCUMENTS

| | | | | |
|---|---|---|---|---|
| 4,349,204 | A * | 9/1982 | Malone | E21B 33/1216 166/120 |
| 4,528,910 | A * | 7/1985 | Blanc | E21B 29/02 102/306 |
| 4,634,314 | A | 1/1987 | Pierce | |
| 4,892,144 | A * | 1/1990 | Coone | E21B 33/1277 166/122 |
| 5,195,583 | A | 3/1993 | Toon et al. | |
| 5,697,442 | A | 12/1997 | Baldridge | |
| 5,979,508 | A | 11/1999 | Cherrington | |
| 9,376,871 | B2 | 6/2016 | Levie et al. | |
| 9,404,317 | B2 | 8/2016 | Levie et al. | |
| 2007/0221387 | A1* | 9/2007 | Levy | E21B 33/1208 166/387 |
| 2007/0284037 | A1 | 12/2007 | Buytaert | |
| 2009/0301715 | A1* | 12/2009 | Corre | E21B 33/1277 166/250.17 |
| 2010/0059218 | A1 | 3/2010 | Whitelaw | |
| 2011/0114338 | A1 | 5/2011 | Casassa et al. | |
| 2012/0186808 | A1 | 7/2012 | Lively et al. | |
| 2012/0292043 | A1 | 11/2012 | Thornton | |
| 2013/0180736 | A1* | 7/2013 | Hallundbæk | E21B 33/1208 166/387 |
| 2014/0367085 | A1 | 12/2014 | Levie et al. | |

FOREIGN PATENT DOCUMENTS

| | | | |
|---|---|---|---|
| GB | 2431664 | A | 2/1980 |
| GB | 2358418 | A | 7/2001 |
| GB | 2406591 | A | 4/2005 |
| WO | 0204781 | A1 | 1/2002 |
| WO | 2004015238 | A1 | 2/2004 |
| WO | 2011/110819 | A2 | 9/2011 |
| WO | 2013/152940 | A1 | 10/2013 |

OTHER PUBLICATIONS

Combined Search and Examination Report dated Feb. 5, 2014, Great Britain Application No. GB1215868.9, filed Sep. 5, 2012, pp. 1-2.

Andre Van Berlo (Authorized Officer), PCT International Search Report dated Jul. 16, 2014, International Application No. PCT/EP2013/057416, filed Apr. 9, 2013, pp. 1-6.

Sean Dennehey (Director of Patents), Notification of Grant dated Dec. 15, 2014, GB Application No. GB1215868.9, filed Sep. 5, 2012, pp. 1-2.

David E. Y. Levie et al., "Modified Tubular", U.S. Appl. No. 15/207,614, filed Jul. 12, 2016.

* cited by examiner

INTEGRALLY-BONDED SWELL PACKER

CROSS-REFERENCE TO RELATED APPLICATIONS

This application claims priority to U.S. Provisional Patent Application No. 62/328,839 filed on Apr. 28, 2016, and to U.S. Provisional Patent Application No. 62/347,904, filed on Jun. 9, 2016. The entirety of both of these priority provisional applications is incorporated herein by reference.

BACKGROUND

A swell packer typically includes a swellable material positioned around tubular member (e.g., a base pipe). When the swell packer is initially run into a wellbore, an annulus is defined between the swellable material and an outer tubular member such as a liner, a casing, or a wall of the wellbore. The swell packer may be submerged in a liquid in the wellbore, and after a predetermined amount of time in contact with the liquid, the swellable material may swell radially-outward and into contact with the outer tubular member to seal the annulus.

When assembling the swell packer, the swellable material is oftentimes adhered to the outer surface of the tubular member with end rings at a bespoke facility. In other embodiments, the swellable material is sleeved over the tubular member and held in place with end rings. The end rings may be clamped or fastened to the tubular member.

In other cases, the swellable material is bonded to a custom pup joint with end rings installed, specially manufactured for the application. The pup joint is then connected and run as part of the string of tubulars in the well. While pup joint embodiments may be employed successfully in high-pressure environments, the custom design thereof for each different type of tubing string, tubing size, etc., may be expensive and present inventory management issues.

The elastomer in swell packers is designed to swell in a specific medium over a specified time. Once in the medium, the process typically cannot be halted. As a result, any deviation in well construction time as the packers are being run may present a problem as the swell process may occur before the desired time.

SUMMARY

A downhole tool is disclosed. The downhole tool includes a sleeve configured to be disposed around a tubular. An expandable sealing member is coupled to and positioned at least partially around the sleeve. An end ring is coupled to and positioned at least partially around the sleeve and axially-adjacent to the expandable sealing member.

In another embodiment, the downhole tool includes a tubular and a sleeve positioned at least partially around the tubular such that a first annulus is formed between the tubular and the sleeve. A first bonding material is positioned in the first annulus. An expandable sealing member is coupled to and positioned at least partially around the sleeve. A first end ring is coupled to and positioned at least partially around the sleeve. A second end ring is coupled to and positioned at least partially around the sleeve. The expandable sealing member is positioned axially-between the first and second end rings.

A method for assembling a downhole tool is also disclosed. The method includes positioning an expandable sealing member at least partially around a sleeve. A first shell is positioned at least partially around the sleeve. A first bonding material is introduced into a first annulus formed between the sleeve and the first shell. The first shell and the first bonding material form a first end ring when the first bonding material cures. The sleeve is positioned at least partially around a tubular. A second bonding material is introduced into a second annulus formed between the tubular and the sleeve.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
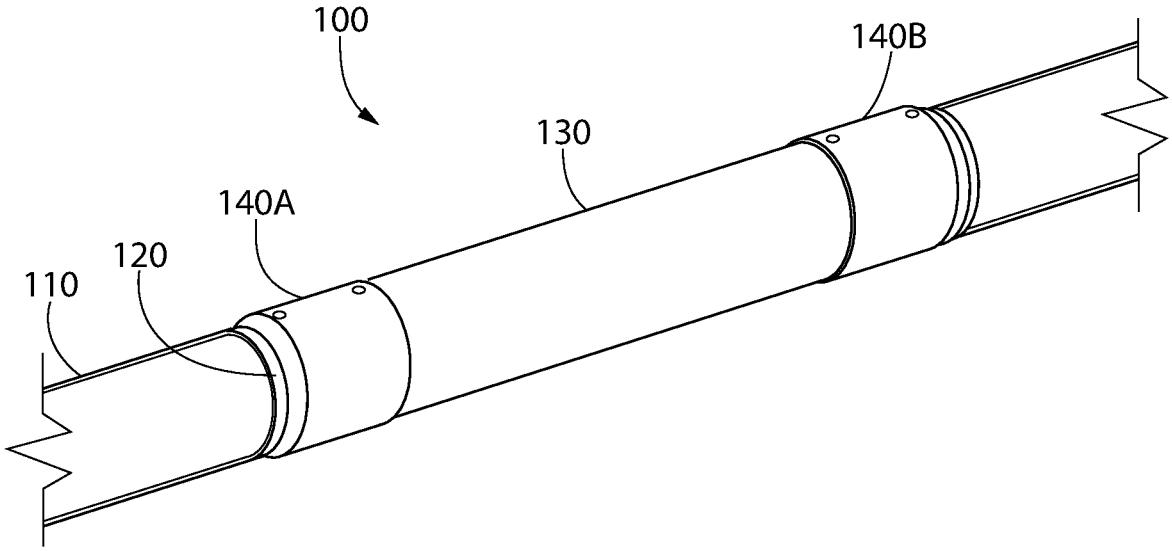
FIG. 1 illustrates a perspective view of a downhole tool positioned on an oilfield tubular, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, the present disclosure provides a downhole tool that includes an expandable (e.g., swellable) member on a sleeve. The sleeve fits around a segment of a standard oilfield tubular, such as a joint of casing, liner, drill pipe, production tubing, etc. In some embodiments, the sleeve may be bonded to the oilfield tubular after assembly with the expandable member. As such, the tool may be installed in the field, e.g., fixed to the oilfield tubular just prior to running into the well. In particular, in some embodiments, the expandable member is bonded around the sleeve, and a pair of end rings are positioned around the sleeve on either axial side of the expandable member. The end rings each include one or more shells, which may be bonded or otherwise fixed to the sleeve.

Turning to the specific, illustrated embodiments, FIG. 1 illustrates a perspective view of a downhole tool 100 positioned on an oilfield tubular 110, according to an embodiment. The downhole tool 100 may be or include a swell packer, but, in other embodiments, may be or additionally include other types of oilfield tools. The downhole tool 100 may include a sleeve 120 that is configured to be positioned at least partially around the oilfield tubular 110. The sleeve 120 is described in greater detail with respect to FIG. 2.

The downhole tool 100 may include an expandable member 130 that is positioned at least partially around the sleeve 120. The expandable member 130 may be or include a swellable material or an inflatable material. For example, the expandable member 130 may be or include an elastomer that swells radially-outward to seal against a surrounding tubular (e.g., a liner, a casing, or a wellbore wall) when in contact with one or more predetermined fluids for a predetermined amount of time. The fluids may be or include water, hydrocarbons, or other fluids that may be found within, or injected into, a wellbore. In at least one embodiment, an outer surface of the elastomer of the expandable member 130 may have a coating (e.g., sealing material) positioned thereon that prevents the ingress of the fluids to the expandable member 130, such as a swellable material. The coating may be or include urethane. The coating may be degraded or dissolved by circulating a pill into the wellbore, thereby placing the swellable material in contact with the fluid. The pill may be or include formic acid.

The downhole tool 100 may include one or more end rings (two are shown: 140A, 140B) that are positioned at least partially around the sleeve 120. The expandable member 130 may be positioned axially-between the end rings 140A, 140B. The end rings 140A, 140B may be coupled to the sleeve 120 and serve to hold the expandable member 130 axially in-place on the sleeve 120. The end rings 140A, 140B are described in greater detail with respect to FIG. 3.

Figure 2:
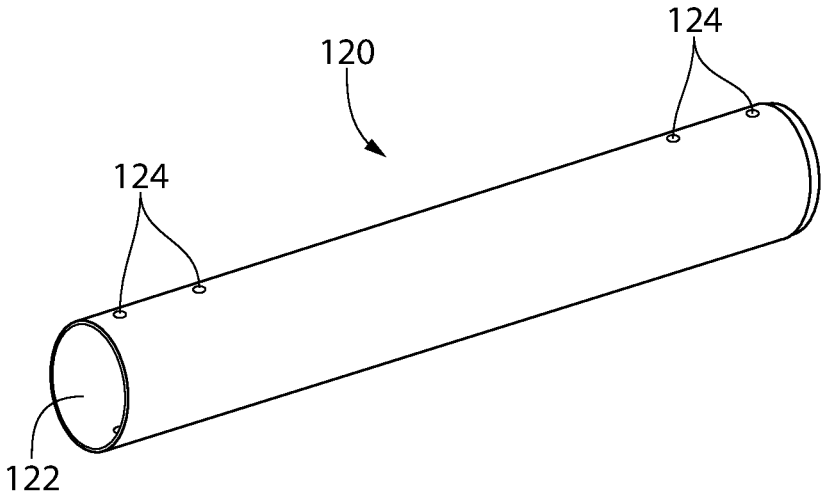
FIG. 2 illustrates a perspective view of a sleeve of the downhole tool, according to an embodiment.

FIG. 2 illustrates a perspective view of the sleeve 120, according to an embodiment. The sleeve 120 may be an annular tubular member having an axial bore 122 formed at least partially therethrough. The sleeve 120 may be made of a composite material, such as carbon fiber, glass fiber, KEVLAR®, or the like. Since the sleeve 120 is configured to be positioned around the oilfield tubular 110, rather than connected end-to-end such as is the case with a pup joint, the sleeve 120 may be free from end connections (e.g., a pin and box end) configured to adjoin the sleeve 120 to an adjacent tubular.

An outer surface of the sleeve 120 may have one or more recesses (four are shown: 124) formed therein. The recesses 124 may be positioned proximate to the axial ends of the sleeve 120. The recesses 124 may extend partially radially through the sleeve 120 or fully radially through the sleeve 120 (e.g., to an inner surface of the sleeve 120). The recesses 124 may be axially-offset from one another, circumferentially-offset from one another, or a combination thereof. In some embodiments, the recesses 124 may be circular holes, but in other embodiments, the recesses 124 may be elongated slots or any other suitable shape.

Figure 3:
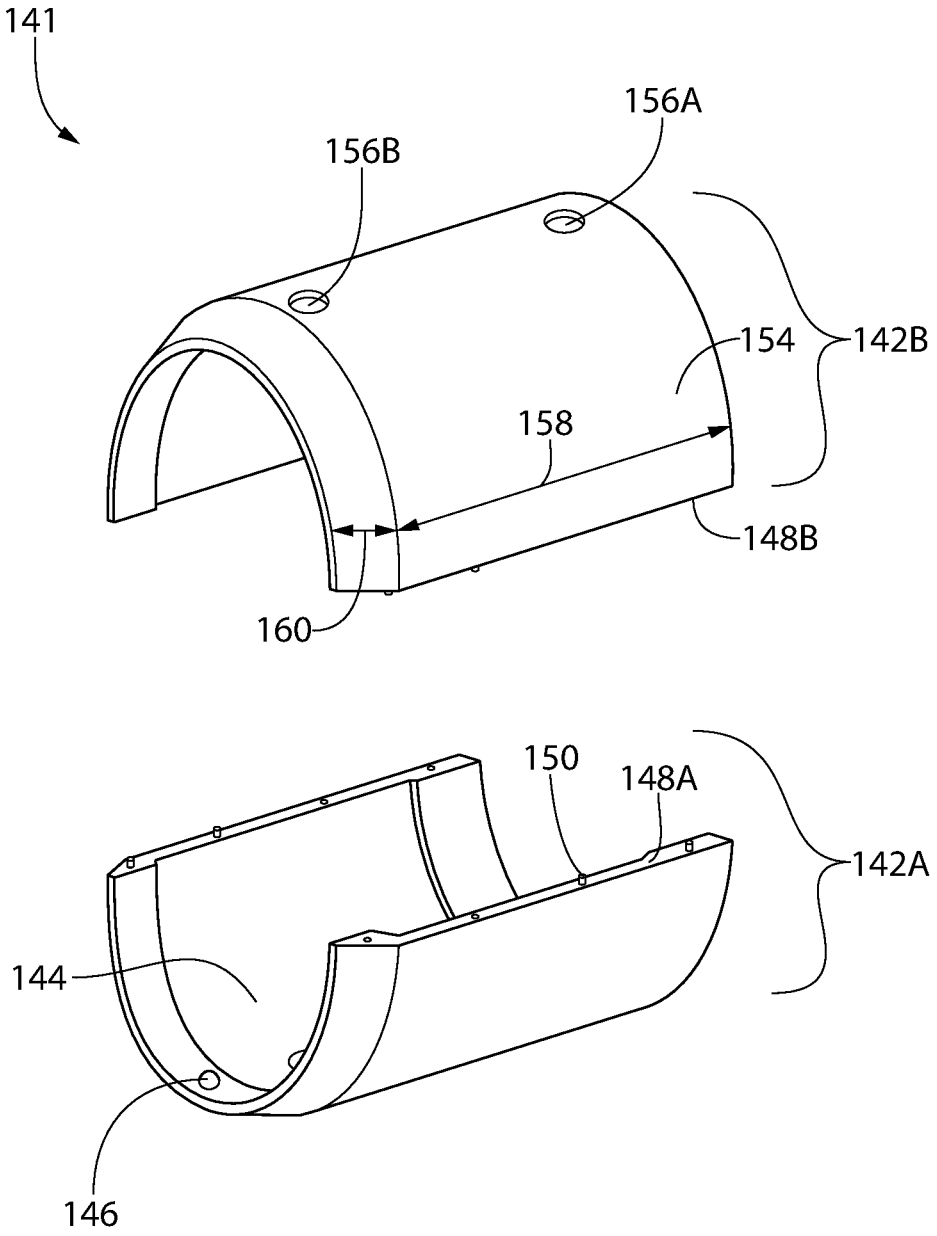
FIG. 3 illustrates an exploded perspective view of a shell used to form an end ring of the downhole tool, according to an embodiment.

FIG. 3 illustrates an exploded perspective view of a shell 141 used to form the first end ring 140A, according to an embodiment. The shell 141 may be made of a composite material, as described in U.S. Patent Publication No. 2014/0367085, which is incorporated by reference in its entirety to the extent not inconsistent with the present disclosure. In one example, to produce the shell 141, a fiber mat may be infused with a resin matrix. For example, the fiber mat may be passed through a bath containing the resin matrix. Infusion may also be achievable in other ways, such as applying the resin matrix liberally to the fiber mat by pouring or spraying or by a pressure treatment to soak, or impregnating the fiber mat with the resin matrix. Ceramic particulates, for example hard-wearing materials such as a combination of zirconium dioxide and silicon nitride, optionally in bead form, may be applied to the resin matrix infused fiber mat. A friction modifying material such as fluorocarbon particulates providing a low friction coefficient may also be applied to the resin matrix infused fiber mat.

In at least one embodiment, a KEVLAR® honeycomb layer with the ceramic composite material incorporated may be applied to the resin matrix infused fiber mat. This layer may be placed into the mold along with the other layers of the resin matrix infused fiber mat. The resin matrix infused fiber mat may be introduced to a mold such that surfaces treated with the aforesaid particulates are adjacent to the mold surfaces. Multiple additional layers of the resin matrix infused fiber mat, which may or may not each have been treated with particulates, may be laid up into the mold on to the first resin matrix infused fiber mat lining the mold until a predetermined thickness is attained. Then, the mold may be closed. A resin filler matrix may be introduced into the mold using a low pressure resin transfer molding process. In an example of such a process, a mixed resin and catalyst or resin curing agent are introduced, for example by injection, into the closed mold containing the resin matrix infused fiber and particulates lay up. In this way the composite shell 141 may be formed, according to a specific embodiment. The mold may be heated in order to achieve first cure. After curing the resin to an extent that permits handling of the shell 141, the mold can be opened and the formed shell 141 removed. A post cure of the formed shell 141 may be carried out. The post cure may be or include a heat treatment, for example conducted in an oven. It will be appreciated that the foregoing forming processes for the shell 141 represent merely a few examples among many contemplated.

The shell 141 of the second end ring 140B may be substantially identical to the shell of the first end ring 140A. As shown, the shell 141 may include two circumferentially-adjacent components or portions 142A, 142B. In another embodiment, the shell 141 may include three or more circumferentially-adjacent components. In yet another embodiment, the shell 141 may be a single annular component.

In the embodiment shown, an end profile of each of the components 142A, 142B may extend through about 180° (e.g., the end profile may be semi-circular). In other embodiments, the end profiles may be different. For example, the end profile of the first component 142A may extend through about 270°, and the end profile of the second component 142B may extend through about 90°.

An inner surface 144 of the components 142A, 142B may have one or more protrusions 146 that extend radially-inward therefrom. As described in greater detail below, the protrusions 146 may be inserted into the recesses 124 in the sleeve 120 (e.g., FIG. 2) when the downhole tool 100 is being assembled. This may help position the shell 141 on the sleeve 120 for subsequent bonding.

An axially-extending surface 148A of the first component 142A may have one or more protrusions 150 that extend therefrom. The axially-extending surface 148A may be, for example, at a circumferential extent of the first component 142A, where an interface will be formed between the first and second components 142A, 142B. The protrusions 150 may be axially-offset from one another along the axially-extending surface 148A. An axially-extending surface 148B of the second component 142B may have one or more recesses (not shown) formed therein that are configured to mate with the protrusions 150 on the first component 142A. The recesses may be axially-offset from one another along the axially-extending surface 148B. In another embodiment, the axially-extending surface 148A of the first component 142A and the axially-extending surface 148B of the second component 142B may each have one or more protrusions 150 and one or more recesses. The protrusions 150 may be aligned with and inserted into the recesses when the components 142A, 142B are coupled together. The insertion of the protrusions 150 into the recesses may help align and position the components 142A, 142B together.

An outer surface 154 of the components 142A, 142B may have one or more openings (two are shown: 156A, 156B) formed therethrough. More particularly, the openings 156A, 156B may be formed radially-through the components 142A, 142B (i.e., from the outer surface 154 to the inner surface 144). As described in greater detail below, one of the openings 156A may serve as an "injection port" through which a bonding material may be introduced, and one of the openings 156B may serve as a "vacuum port" through which air may be removed when the bonding material is being introduced. In some embodiments, the vacuum port may be omitted.

In at least one embodiment, the components 142A, 142B may each include a first portion 158 that is positioned adjacent to (e.g., abuts) the expandable member 130 when the downhole tool 100 is assembled, and a second portion 160 that is positioned distal to the expandable member 130 when the downhole tool 100 is assembled. A radius of the inner surface 144 and/or the outer surface 154 of the first portion 158 may be substantially constant proceeding in an axial direction. The radius of the inner surface 144 of the first portion 158 may be larger than the radius of the outer surface of the sleeve 120 such that a cavity exists between the sleeve 120 and the inner surface 144 of the first portion 158 when the first shell 141 is assembled around the sleeve 120. A radius of the inner surface 144 and/or the outer surface 154 of the second portion 160 may taper down proceeding away from the first portion 158, further defining the cavity. For example, the radius of the inner surface 144 of the second portion 160 may taper down to be within about 1 mm of a radius of the outer surface of the sleeve 120. In other embodiments, the second portion 160 may taper down to other measurements with respect to the sleeve 120. The upper surface of the opposing end of the first portion 158 may taper down to the outer surface of the expandable member 130.

The bonding material introduced via the opening 156A (or 156B) may substantially fill the cavity defined between the inner surface 144 and the sleeve 120 (e.g., FIG. 2). Thus, the bonding material, once cured, may form part of the structure of the end rings 140A, 140B, adding to the structural integrity thereof. Further, the bonding material in the cavity or annulus provides side surfaces/interfaces with the shells 141, which aid in preventing displacement, whether rotationally or translationally, of the end rings 140A, 140B with respect to the sleeve 120.

Figure 4A:
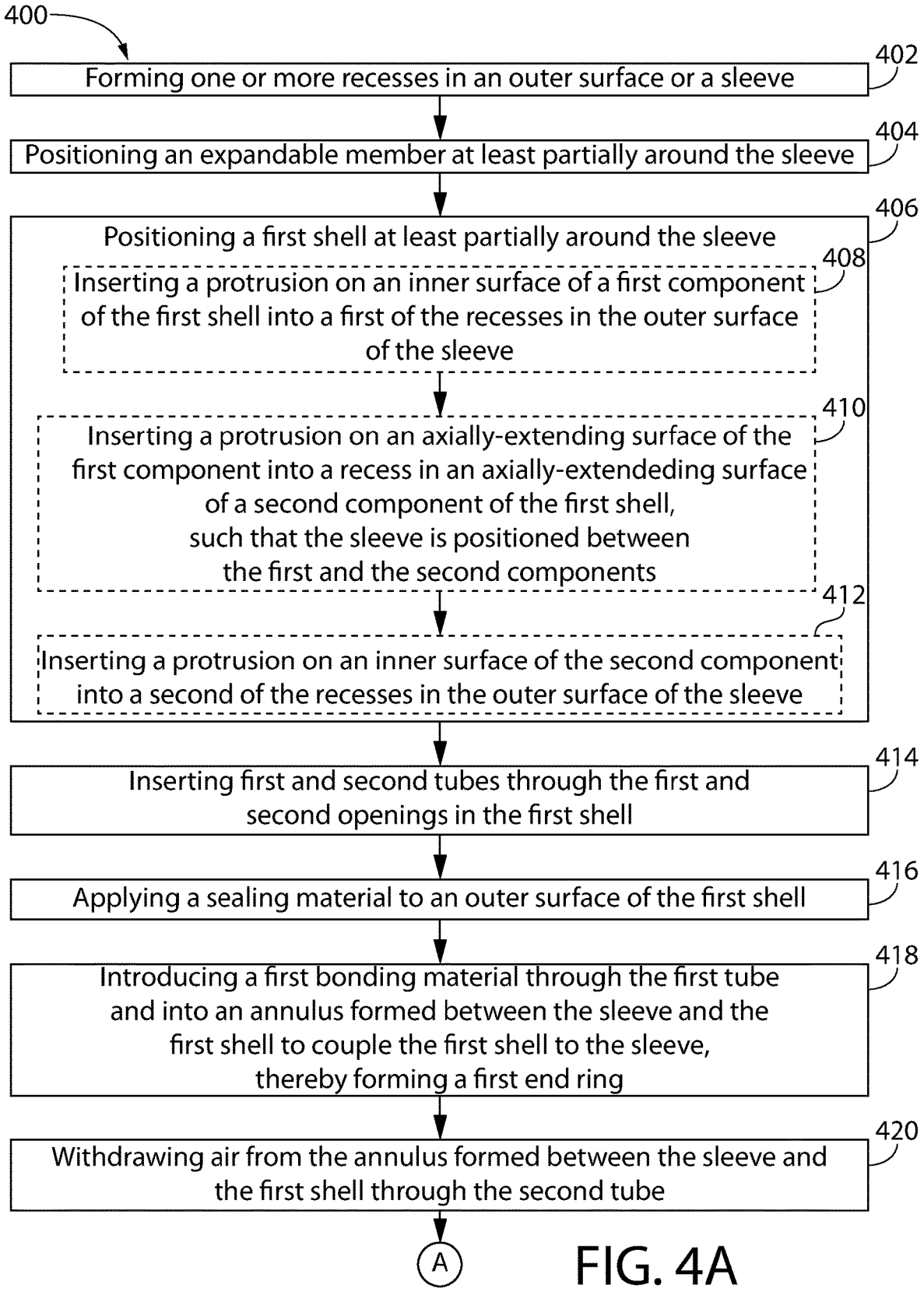
FIGS. 4A and 4B illustrate a flowchart of a method for assembling the downhole tool, according to an embodiment.
Figure 4B:
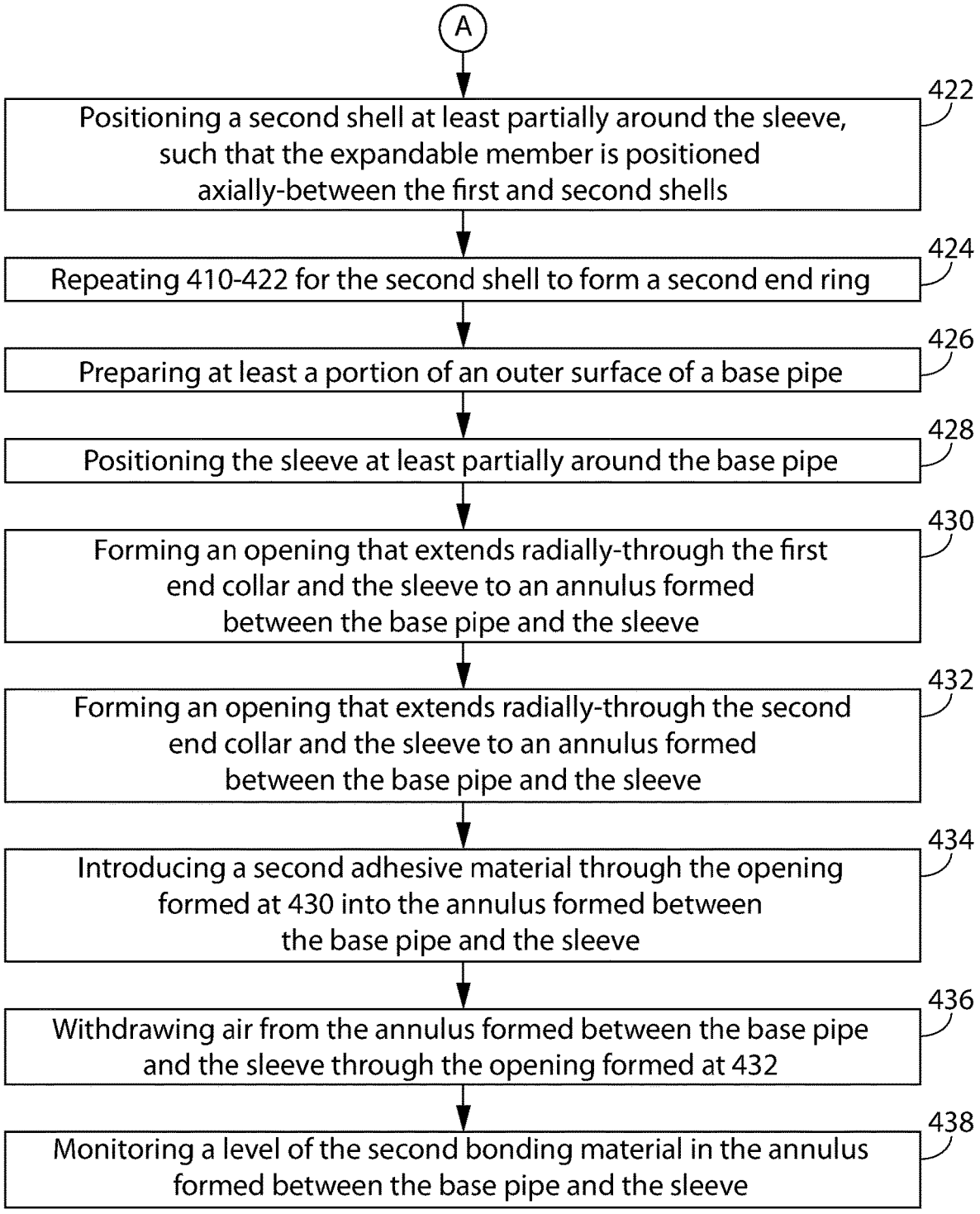

FIGS. 4A and 4B illustrate a flowchart of a method 400 for assembling the downhole tool 100, according to an embodiment. An understanding of the method 400 may be furthered by reference to U.S. Patent Publication No. 2014/0367085, incorporated by reference above. The method 400 may be viewed together with FIG. 5-8, which show the downhole tool 100 at various stages of assembly. Beginning with reference to FIG. 5, in addition to FIG. 4A, the method 400 may include forming the recess(es) 124 in the outer surface of the sleeve 120, as at 402. For example, the recess(es) 124 may be formed in the outer surface of the sleeve 120 using a drill or during the process of molding or otherwise forming the sleeve 120 itself.

Figure 5:
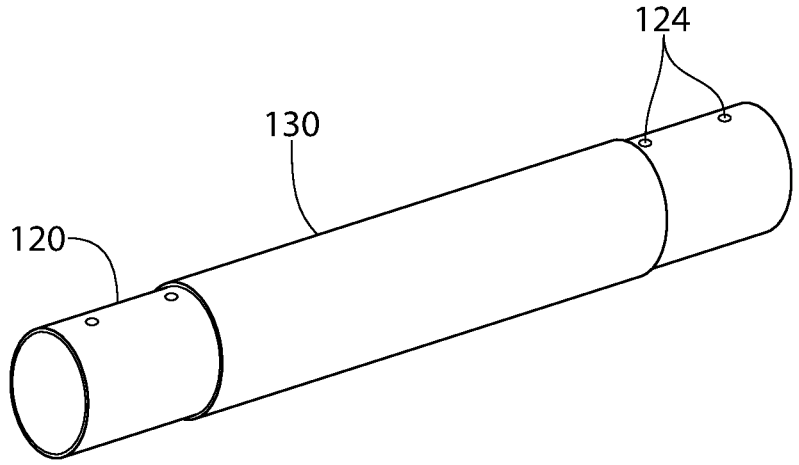
FIG. 5 illustrates a perspective view of an expandable member positioned around the sleeve, according to an embodiment.

The method 400 may include positioning the expandable member 130 at least partially around the sleeve 120, as at 404. This is also shown in FIG. 5. For example, the sleeve 120 may be introduced into the bore of the expandable member 130, and the sleeve 120 and the expandable member 130 may be moved axially with respect to one another until the expandable member 130 is positioned axially-between the axial ends of the sleeve 120. More particularly, the expandable member 130 may be positioned axially-between one or more of the recesses 124 that are positioned proximate to a first axial end of the sleeve 120 and one or more of the recesses 124 that are positioned proximate to a second axial end of the sleeve 120. Thus, at least one or more of the recesses 124 are not covered by the expandable member 130. Once in place, the expandable member 130 may be vulcanized onto the sleeve 120.

Figure 6:
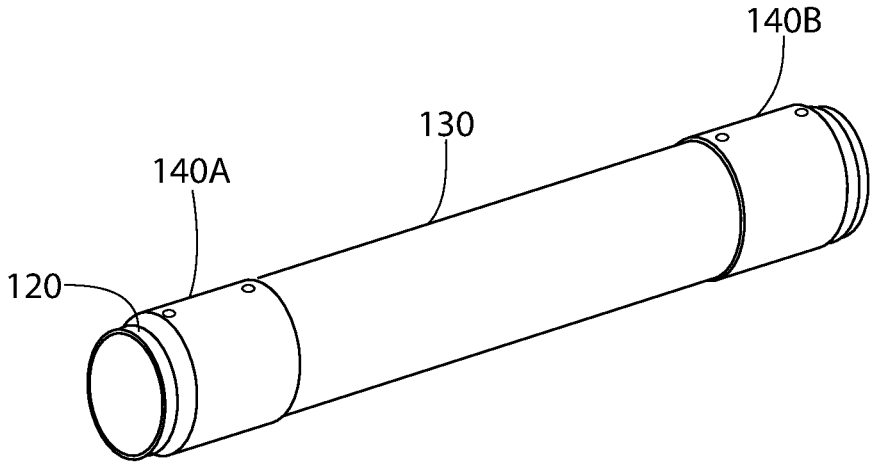
FIG. 6 illustrates a perspective view of the expandable member positioned around the sleeve and between two end rings, according to an embodiment.

Referring now to FIG. 6 in addition to FIG. 4A, the method 400 may include positioning the first shell 141 at least partially around the sleeve 120, as at 406. Positioning the first shell 141 at least partially around the sleeve 120 may include inserting the protrusion(s) 146 on the inner surface 144 of the first component 142A into the recess(es) 124 in the outer surface of the sleeve 120, as at 408.

Positioning the first shell 141 at least partially around the sleeve 120 may include inserting the protrusion(s) 150 on the axially-extending surface 148A of the first component 142A into the recess(es) in the axially-extending surface 148B of the second component 142B, such that the sleeve 120 is positioned between the first and second components 142A, 142B, as at 410. Additionally or alternatively, positioning the first shell 141 at least partially around the sleeve 120 may also include inserting the protrusion(s) 150 on the axially-extending surface 148B of the second component 142B into the recess(es) in the axially-extending surface 148A of the first component 142A, such that the sleeve 120 is positioned between the first and second components 142A, 142B.

Positioning the first shell 141 at least partially around the sleeve 120 may include inserting the protrusion(s) 146 on the inner surface 144 of the second component 142B into the recess(es) 124 in the outer surface of the sleeve 120, as at 412. In at least one embodiment, this may occur substantially simultaneously with the insertion of the protrusion(s) 150 into the recess(es).

The method 400 may optionally include inserting tubes through the openings 156A, 156B in the first shell 141, as at 414. The tubes may provide a path of fluid communication from the exterior of the first shell 141, through the openings 156A, 156B, and to the annulus formed between the sleeve 120 and the first shell 141. In another embodiment, the tubes may be unnecessary and the openings 156A, 156B may provide the path. In one embodiment, both components 142A, 142B may be put into position before injection of the first bonding material 126.

The method 400 may include applying a sealing material to at least a portion of the first shell 141, as at 416. The sealing material may be, for example, a vacuum sealing tape. The sealing material may be applied to seal the gap between the second (e.g., tapered) portion 160 of the shell 141 and the sleeve 120, the gap between the shell 141 and the expandable member 130, the gaps between the first and second components 142A, 142B of the first shell 141, the gap(s) surrounding the tubes that extend through the openings 156A, 156B, or a combination thereof The method 400 may include introducing a first bonding material 126 (see FIG. 7) into the cavity formed between the sleeve 120 and the first shell 141, as at 418. More particularly, the first bonding material 126 may be pumped through the tube that extends through the opening 156A into the cavity formed between the sleeve 120 and the first portion 158 of the shell 141. The first bonding material 126 may be or include an epoxy, a resin, a modified epoxy system, a methyl methacrylate ("MMA"), a modified MMA system, or the like. The first bonding material 126 may couple the shell 141 to the sleeve 120 when the first bonding material 126 cures, such that the first bonding material 126 becomes part of the first end ring 140A, providing enhanced strength thereto while resisting displacement of the first end ring 140A relative to the sleeve 120, as described above.

While introducing the first bonding material 126 at 418, the method 400 may include withdrawing/evacuating air from the cavity formed between the sleeve 120 and the shell 141, as at 420. More particularly, air may be withdrawn from the cavity between the sleeve 120 and the first portion 158 of the shell 141 through the tube that extends through the opening 156B. This may create a vacuum effect that causes the first bonding material 126 to flow through and at least substantially fill the cavity more easily.

In some embodiments, the first component 142A of the shell 141 may be affixed to the sleeve 120 prior to the second component 142B, e.g., by introducing the first bonding material 126 into the cavity between the first component 142A and the sleeve 120 prior to receiving the second component 142B onto the sleeve 120. The second component 142B may then be affixed to the first portion 142 and the sleeve 120 in similar fashion.

Again referring to FIG. 6 in addition to FIG. 4B, the method 400 may include positioning a second shell 141 at least partially around the sleeve 120, such that the expandable member 130 is positioned axially-between the first and second shells 141, as at 422. The method 400 may include repeating 410-420 for the second shell 141 to form the second end ring 140B, as at 424. In some embodiments, the first and second shells 141 may be affixed to the sleeve 120 simultaneously. For example, the shells 141 may be positioned around the sleeve 120, and the first bonding material 126 may be injected into the annulus between the sleeve 120 and the shell 141.

The method 400 may include preparing at least a portion of the outer surface of the oilfield tubular 110 for bonding, as at 426. For example, the portion of the outer surface of the oilfield tubular 110 over which the sleeve 120 will be placed may be smoothed, for example, by sand blasting or other techniques.

The method 400 may include positioning the sleeve 120 at least partially around the oilfield tubular 110, as at 428. For example, the oilfield tubular 110 may be introduced into the bore of the sleeve 120, and the oilfield tubular 110 and the sleeve 120 may be moved axially with respect to one another until the sleeve 120 is positioned axially-between the axial ends of the oilfield tubular 110. The sleeve 120 may be positioned at least partially around the oilfield tubular 110 in the field (e.g., at the wellsite).

Figure 7:
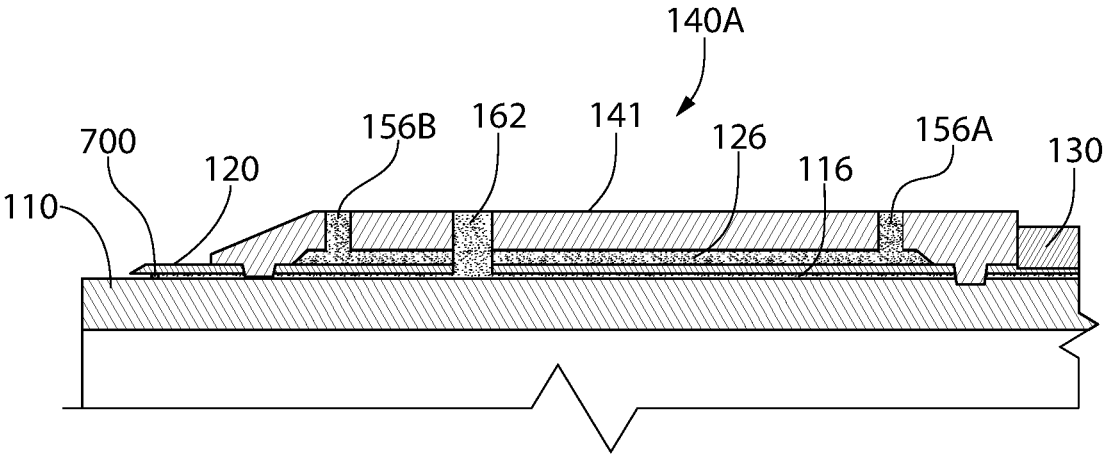
FIG. 7 illustrates a partial cross-sectional view of the downhole tool showing an opening extending radially-through the first end ring and the sleeve to an annulus formed between the oilfield tubular and the sleeve, according to an embodiment.

The method 400 may include forming one or more openings 162 that extend radially-through the first end ring 140A (e.g., the first shell 141 and the first bonding material 126) and the sleeve 120 to an annulus formed between the oilfield tubular 110 and the sleeve 120, as at 430. Similarly, the method 400 may also include forming one or more openings 162 that extend radially-through the second end ring 140B (e.g., the second shell 141 and the first bonding material 126) and the sleeve 120 to the annulus formed between the oilfield tubular 110 and the sleeve 120, as at 432. This is shown in FIG. 7. This may take place at the factory process of tool production, not at the wellsite. Although the opening 162 is shown as separate from the openings 156A, 156B, in at least one embodiment, at least one of the openings 156A, 156B may be extended deeper through the first bonding material 126 and the sleeve 120 allowing the additional opening 162 to be omitted.

Figure 8:
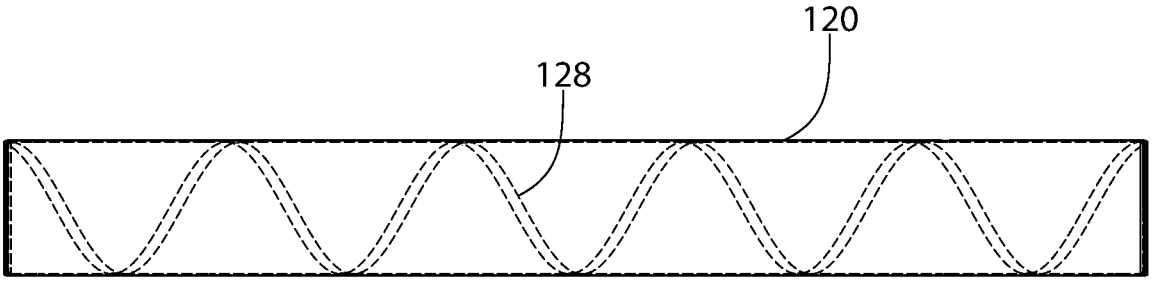
FIG. 8 illustrates a cross-sectional side view of the sleeve showing a groove on an inner surface thereof, according to an embodiment.

The method 400 may include introducing a second bonding material 116 into the annulus formed between the oilfield tubular 110 and the sleeve 120, as at 434. More particularly, the second bonding material 116 may be pumped through the opening(s) 162 into the annulus between the oilfield tubular 110 and the sleeve 120. The second bonding material 116 may be the same as the first bonding material 126, or it may be different. The second bonding material 116 may couple the sleeve 120 to the oilfield tubular 110 when it cures. In at least one embodiment, an inner surface of the sleeve 120 may have one or more ridges (e.g., positive profile) and/or grooves (e.g., negative profile) 128 to facilitate flow of the second bonding material 116 within the annulus between the oilfield tubular 110 and the sleeve 120. This is shown in FIG. 8. The ridges and/or groove(s) 128 may be helical or spiral.

A ring 700 may be positioned between the oilfield tubular 110 and the sleeve 120. The ring 700 may be positioned proximate to an axial end of the sleeve 120 and axially-offset from (e.g., above) the first end ring 140A. In at least one embodiment, the ring 700 may be an inflatable O-ring. The ring 700 may seal the annulus between the oilfield tubular 110 and the sleeve 120 (e.g., to prevent the second bonding material 116 from flowing therepast. The ring 700 may also make the sleeve 120 substantially concentric with the oilfield tubular 110 so the thickness of the second bonding material 116 is substantially uniform around the circumference of the oilfield tubular 110.

The method 400 may include withdrawing/evacuating air from the annulus formed between the oilfield tubular 110 and the sleeve 120, as at 436. More particularly, air may be withdrawn from the annulus between the oilfield tubular 110 and the sleeve 120 through the opening(s) formed at 432. This may create a vacuum effect that causes the second bonding material 116 to flow through the annulus more easily. In at least one embodiment, the air may be withdrawn from the annulus simultaneously with the second bonding material 116 being introduced into the annulus.

The method 400 may include monitoring a level/amount of the second bonding material 116 in the annulus between the oilfield tubular 110 and the sleeve 120, as at 438. The level may be monitored visually or by measuring an amount of the second bonding material 116 introduced into the annulus formed between the oilfield tubular 110 and the sleeve 120 (e.g., with knowledge of the volume of the annulus formed between the oilfield tubular 110 and the sleeve 120).

Figure 9:
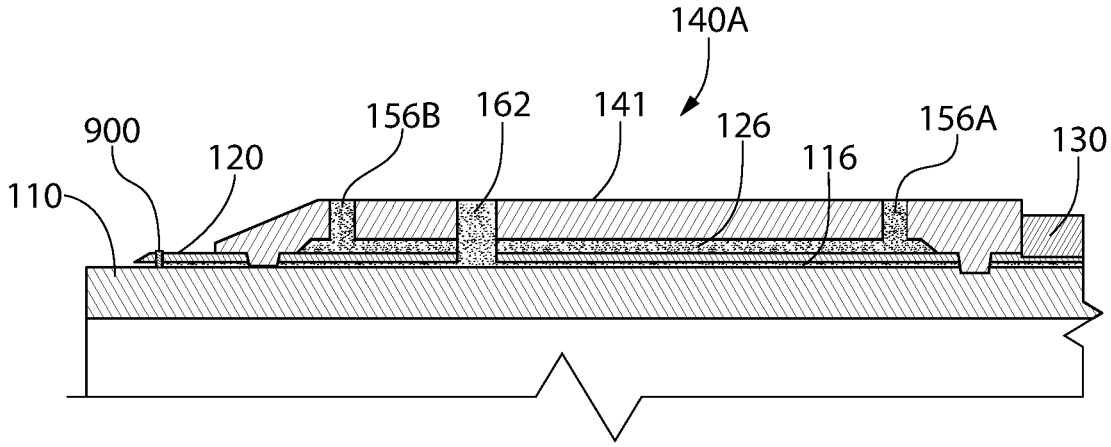
FIG. 9 illustrates a partial cross-sectional view of the downhole tool showing a coupling member coupling the oilfield tubular to the sleeve, according to another embodiment.

FIG. 9 illustrates a partial cross-sectional view of the downhole tool 100 with a coupling member 900 coupling the oilfield tubular 110 to the sleeve 120, according to another embodiment. FIG. 9 is similar to FIG. 7, except the ring 700 is replaced with the coupling member 900. The coupling member 900 may be a composite screw. In at least one embodiment, a plurality of coupling members 900 may be used that are axially and/or circumferentially-offset from one another. The coupling member(s) 900 may make the sleeve 120 substantially concentric with the oilfield tubular 110 so the thickness of the second bonding material 116 is substantially uniform around the circumference of the oilfield tubular 110. When the coupling member(s) 900 is/are used instead of the ring 700, the annulus between the oilfield tubular 110 and the sleeve 120 may be manually sealed.

Figure 10:
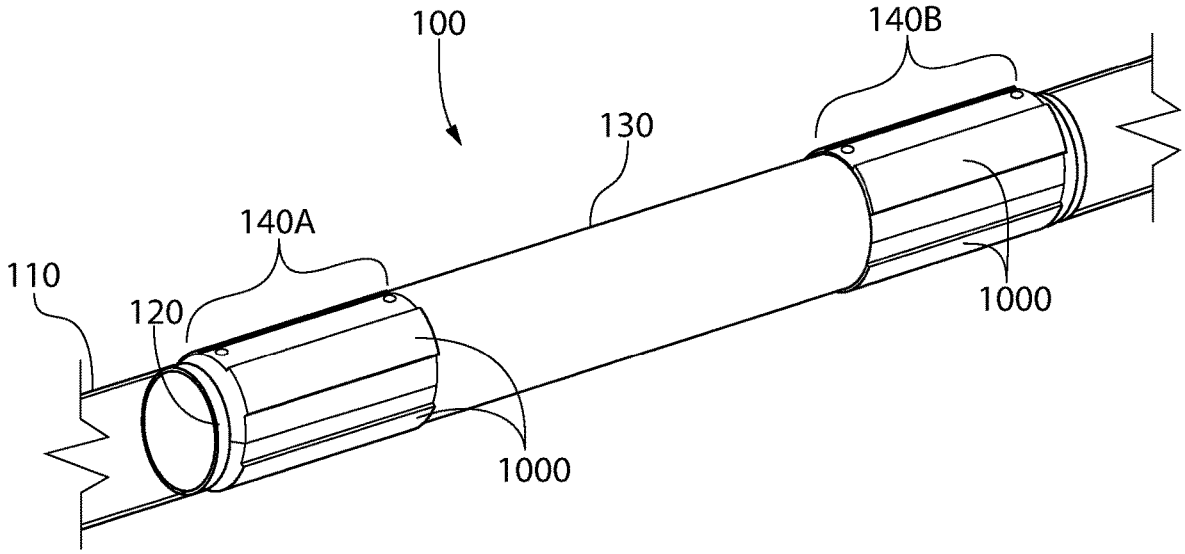
FIG. 10 illustrates a perspective view of the downhole tool showing circumferentially-offset flutes on the outer surface of the end rings, according to an embodiment.
Figure 11:
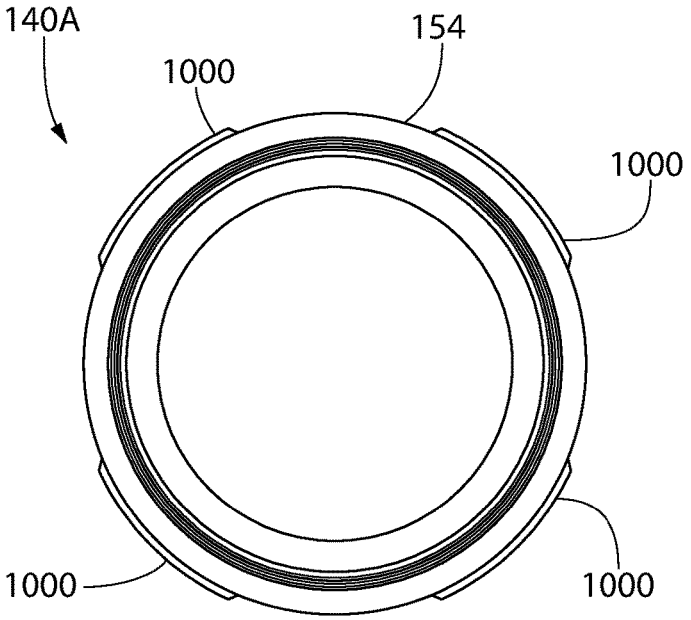
FIG. 11 illustrates an end view of one of the end rings showing the flutes, according to an embodiment.

FIGS. 10 and 11 illustrate a perspective view and a side view, respectively, of the downhole tool 100 showing a plurality of circumferentially-offset flutes 1000 on the outer surface 154 of the end rings 140A, 140B, according to an embodiment. The flutes 1000 may extend axially along the outer surface 154 of the end rings 140A, 140B. In at least one embodiment, an outer surface of the flutes 1000 may be positioned radially-outward from an outer surface of the expandable member 130 before the expandable member 130 expands. The outer surface of the flutes 1000 may be radially-aligned with or positioned radially-inward from the outer surface of the expandable member 130 after the expandable member 130 expands. The flutes 1000 may act as a centralizer for the downhole tool 100 within the surrounding tubular member (e.g., a liner, a casing, or a wall of the wellbore).

Figure 12:
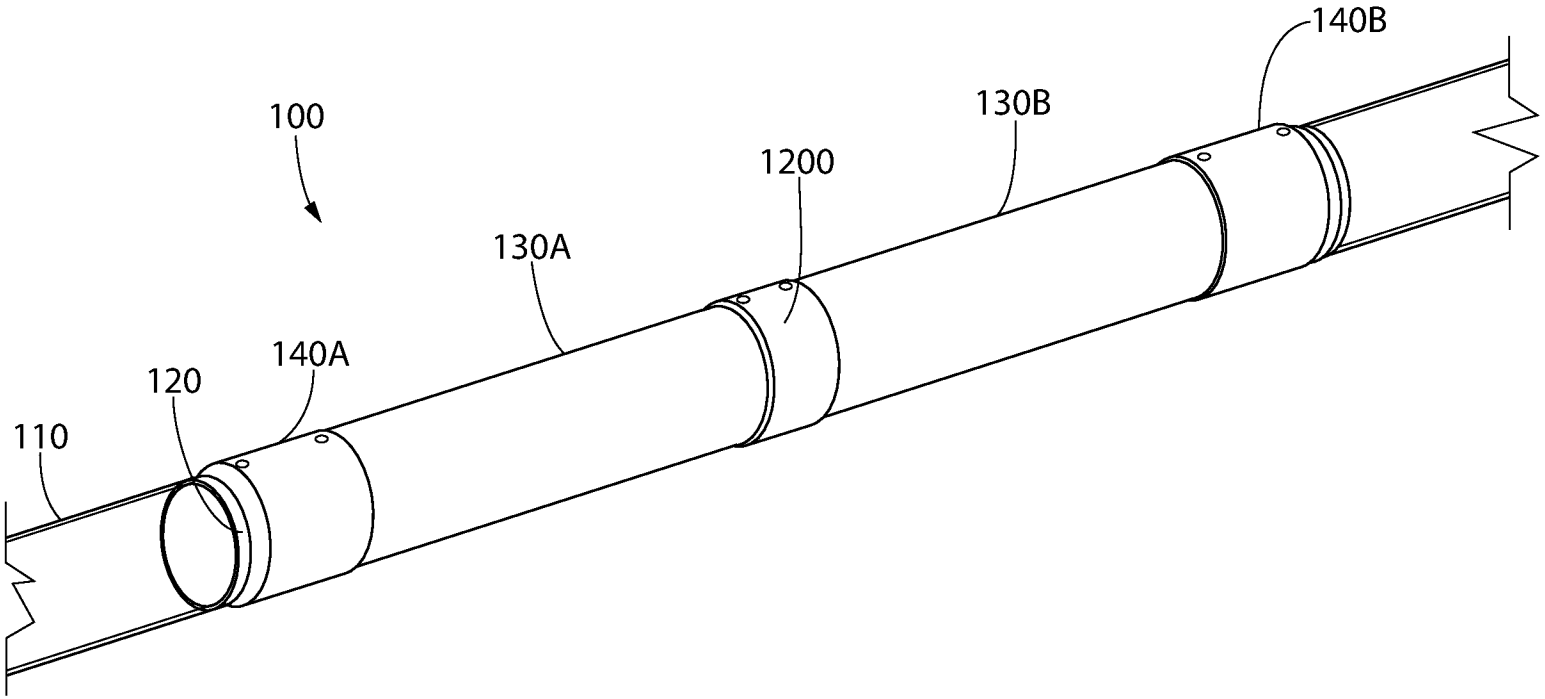
FIG. 12 illustrates a side view of the downhole tool showing an intermediate ring positioned axially-between two expandable members, according to an embodiment.

FIG. 12 illustrates a side view of the downhole tool 100 showing an intermediate ring 1200 positioned axially-between two expandable members 130A, 130B, according to an embodiment. The intermediate ring 1200 may be positioned at least partially around the sleeve 120. In another embodiment, the intermediate ring 1200 may be integral with the sleeve 120. The addition of the intermediate ring 1200 may allow the downhole tool 100 to be a multi-stage downhole tool, with separate expandable members 130A, 130B that may expand at different times and/or in response to different triggers.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a sleeve configured to be disposed around a tubular, wherein an inner annulus is defined at least partially between the tubular and the sleeve;

an inner bonding material layer disposed at least partially within the inner annulus;

an expandable sealing member coupled to and positioned at least partially around the sleeve;

a shell coupled to and positioned at least partially around the sleeve and axially-adjacent to the expandable sealing member with respect to a central-longitudinal axis through the sleeve, around which the sleeve is defined, wherein an outer annulus is defined at least partially between the sleeve and the shell; and an outer bonding material layer disposed at least partially within the outer annulus, wherein a first opening extends through the shell, the outer bonding material layer, and the sleeve to provide a first path of communication for the inner bonding material layer to be introduced into the inner annulus.

2. The downhole tool of claim 1, wherein the shell and the outer bonding material layer comprise an end ring.

3. The downhole tool of claim 2, wherein a second opening extends through the shell to provide a second path of fluid communication for the outer bonding material layer to be introduced into the outer annulus.

4. The downhole tool of claim 2, wherein an inner surface of the shell comprises a protrusion extending radially-inward therefrom, wherein an outer surface of the sleeve has a recess formed therein, and wherein the protrusion is inserted at least partially into the recess.

5. The downhole tool of claim 2, wherein the shell comprises first and second components that are circumferentially-adjacent to one another around the sleeve with respect to the central-longitudinal axis through the sleeve, and wherein the outer annulus is defined by the first and second components and the sleeve.

6. The downhole tool of claim 5, wherein an axially-extending surface of the first component comprises a protrusion extending therefrom, wherein an axially-extending surface of the second component has a recess formed therein, and wherein the protrusion is inserted at least partially into the recess.

7. The downhole tool of claim 1, wherein the sleeve is at least partially made from a composite material and is free from end connections.

8. The downhole tool of claim 1, wherein the shell is a first shell, the downhole tool further comprising:

a second shell coupled to and positioned at least partially around the sleeve, wherein the expandable sealing member is positioned axially-between the first and second shells.

9. The downhole tool of claim 8, further comprising an O-ring positioned between the tubular and the sleeve.

10. The downhole tool of claim 9, wherein the O-ring is inflatable.

11. The downhole tool of claim 8, further comprising a plurality of screws coupled to and positioned at least partially between the tubular and the sleeve, wherein the screws are circumferentially-offset from one another.

12. A downhole tool, comprising:

a tubular;

a sleeve positioned at least partially around the tubular such that an inner annulus is formed between the tubular and the sleeve;

an inner bonding material layer positioned in the inner annulus;

an expandable sealing member coupled to and positioned at least partially around the sleeve;

a first end ring coupled to and positioned at least partially around the sleeve, wherein the first end ring comprises:

a shell, wherein an outer annulus is defined at least partially between the sleeve and the shell; and an outer bonding material layer disposed at least partially within the outer annulus, wherein a first opening extends through the shell, the outer bonding material layer, and the sleeve to provide a first path of communication for the inner bonding material layer to be introduced into the inner annulus; and a second end ring coupled to and positioned at least partially around the sleeve, wherein the expandable sealing member is positioned axially-between the first and second end rings.

13. The downhole tool of claim 12, further comprising an O-ring positioned between the tubular and the sleeve.

14. The downhole tool of claim 13, wherein the O-ring is inflatable.

15. The downhole tool of claim 12, further comprising a plurality of screws coupled to and positioned at least partially between the tubular and the sleeve, wherein the screws are circumferentially-offset from one another.

16. The downhole tool of claim 12, wherein a second opening extends through the shell to provide a second path of fluid communication for the outer bonding material layer to be introduced into the outer annulus.

17. A method for assembling a downhole tool, comprising:

positioning an expandable sealing member at least partially around a sleeve;

positioning a first shell at least partially around the sleeve and axially-adjacent to the expandable sealing member with respect to a central-longitudinal axis through the sleeve and about which the sleeve is defined;

introducing an outer bonding material into an outer annulus formed between the sleeve and the first shell, wherein the first shell and the outer bonding material layer form a first end ring when the outer bonding material cures;

positioning the sleeve at least partially around a tubular; and introducing an inner bonding material through a first opening that extends through the first shell, the outer bonding material layer, and the sleeve into an inner annulus formed between the tubular and the sleeve.

18. The method of claim 17, further comprising forming a recess in an outer surface of the sleeve, wherein positioning the first shell at least partially around the sleeve comprises inserting a protrusion extending radially-inward from an inner surface of the first shell into the recess.

19. The method of claim 17, wherein the first shell comprises first and second components that are circumferentially-adjacent to one another around the sleeve, and wherein positioning the first shell at least partially around the sleeve comprises inserting a protrusion extending from an axially-extending surface of the first component into a recess formed in an axially-extending surface of the second component.

20. The method of claim 17, further comprising introducing a tube through the first opening wherein the inner bonding material is introduced into the inner annulus through the tube.

21. The method of claim 20, further comprising withdrawing air from the inner annulus through a second opening that extends through the first shell, the outer bonding material layer, and the sleeve simultaneously with the inner bonding material being introduced into the inner annulus.

22. The method of claim 17, further comprising applying a sealing material to at least a portion of an outer surface of the first shell before the outer bonding material is introduced into the outer annulus.

23. The method of claim 17, further comprising:

positioning a second shell at least partially around the sleeve, wherein the expandable sealing member is positioned axially-between the first and second shells; and introducing additional outer bonding material into another outer annulus formed between the sleeve and the second shell, wherein the second shell and the additional outer bonding material form a second end ring when the additional outer bonding material cures.

24. The method of claim 17, further comprising forming a second opening that extends through the first end ring into the outer annulus, wherein the outer bonding material is introduced into the outer annulus through the second opening.

* * * * *